US005364049A

United States Patent [19]

Long

[11] Patent Number: 5,364,049

[45] Date of Patent: Nov. 15, 1994

[54] VEHICULAR MOUNTING SYSTEM FOR DIRECTIONAL ANTENNAS

[75] Inventor: Scott B. Long, Portland, Oreg.

[73] Assignee: Radar Engineers, Portland, Oreg.

[21] Appl. No.: 915,456

[22] Filed: Jul. 15, 1992

[51] Int. Cl.[5] ..... H01Q 1/32

[52] U.S. Cl. ..... 248/205.1; 343/714; 343/882

[58] Field of Search ..... 248/122, 205.1, 282, 248/283, 289.1; 343/713, 714, 715, 882; 474/148, 150, 273

[56] References Cited

U.S. PATENT DOCUMENTS

| | | | |
|---|---|---|---|
| 800,658 | 10/1905 | Kitsee | 343/713 |
| 1,060,840 | 5/1913 | Hines | 474/150 |
| 1,464,168 | 8/1923 | Booth et al. | 343/714 |
| 1,705,142 | 3/1929 | Rubio | 248/289.1 |
| 2,556,026 | 6/1951 | Carlisle | 248/289.1 |
| 2,895,752 | 7/1959 | Barrie . | |
| 3,230,533 | 1/1966 | Brill . | |
| 3,729,741 | 4/1973 | Otto . | |
| 3,860,932 | 1/1975 | Hochbrueckner . | |
| 4,107,695 | 8/1978 | Urban et al. . | |
| 4,460,895 | 7/1984 | Bert et al. . | |
| 4,794,399 | 12/1988 | Sensibaugh | 343/882 |
| 4,887,091 | 12/1989 | Yamada . | |
| 5,003,320 | 3/1991 | Miranda . | |

FOREIGN PATENT DOCUMENTS

| | | | |
|---|---|---|---|
| 3406444 | 8/1985 | Germany | 343/713 |

OTHER PUBLICATIONS

*Transmitter Hunting, Radio Direction Finding Simplified,* by Joseph D. Moell and Thomas N. Curlee, published 1987, pp. 72–73.

*Primary Examiner*—Eugenia Jones
*Assistant Examiner*—Allan M. Schrock
*Attorney, Agent, or Firm*—Kolisch, Hartwell, Dickinson, McCormack & Heuser

[57] ABSTRACT

A system is provided for mounting directional antennas on vehicles. The mounting system employs a conventional roof rack as a support base for the antenna mount. In one embodiment, a straight tubular frame member is attachable to the roof rack. An upwardly-extending rotatable shaft extends from adjacent one end of the frame, for supporting the antenna mast, and a downwardly-extending rotatable shaft, supporting a control handle, extends from adjacent the other end of the frame. The rotational movements of the shafts are tied together by a toothed belt which engages sprockets coupled to the shafts. In its preferred form, the control handle includes tactile positioning indicators on its surface which allow the user to sense the direction of the antenna without having to view it. A second embodiment is disclosed which uses a portion of a tubular horizontal bar on a conventional roof rack as part of the support frame of the device. The antenna mounting system allows an operator to fully control the rotation of the antenna through 360-degrees without the need to drill a hole through the roof of the vehicle.

13 Claims, 2 Drawing Sheets

FIG. 1
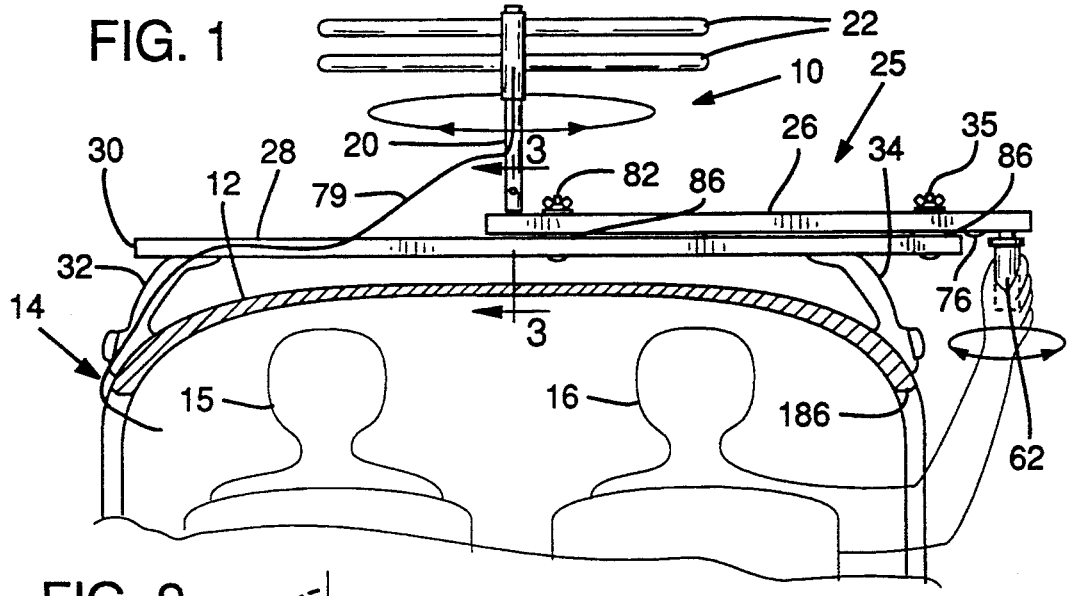
FIG. 2
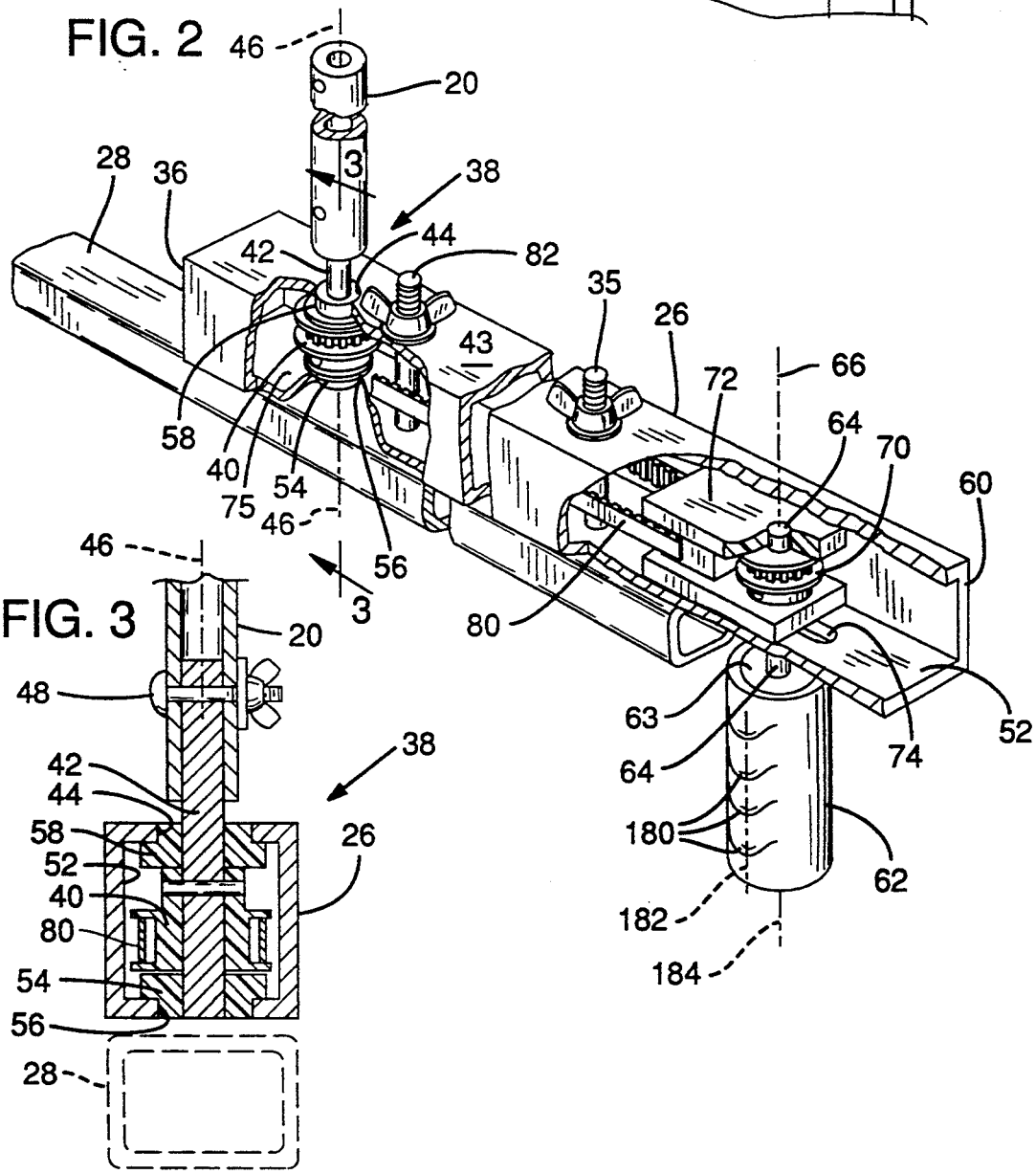
FIG. 3

FIG. 4
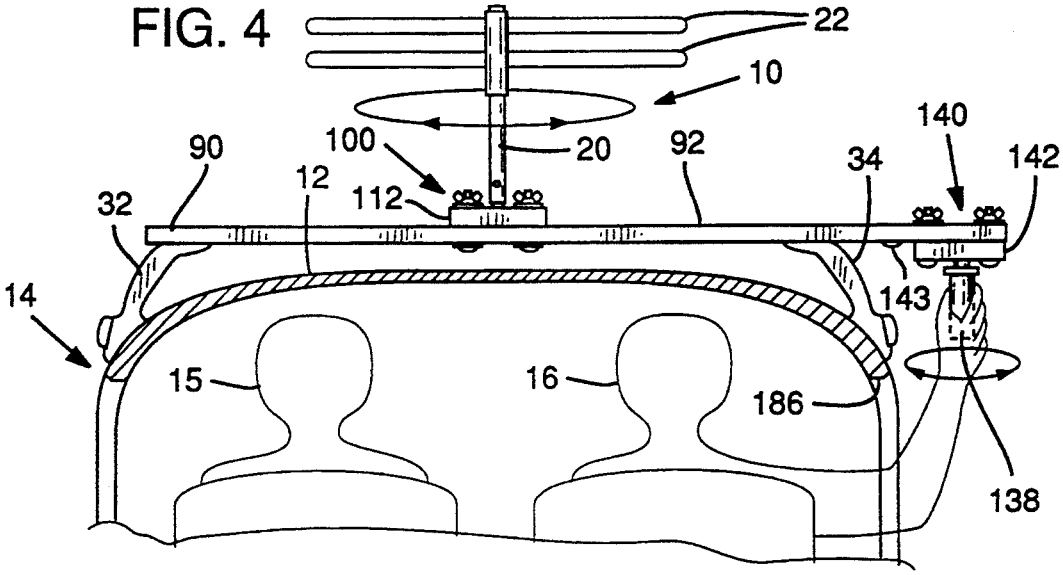
FIG. 5
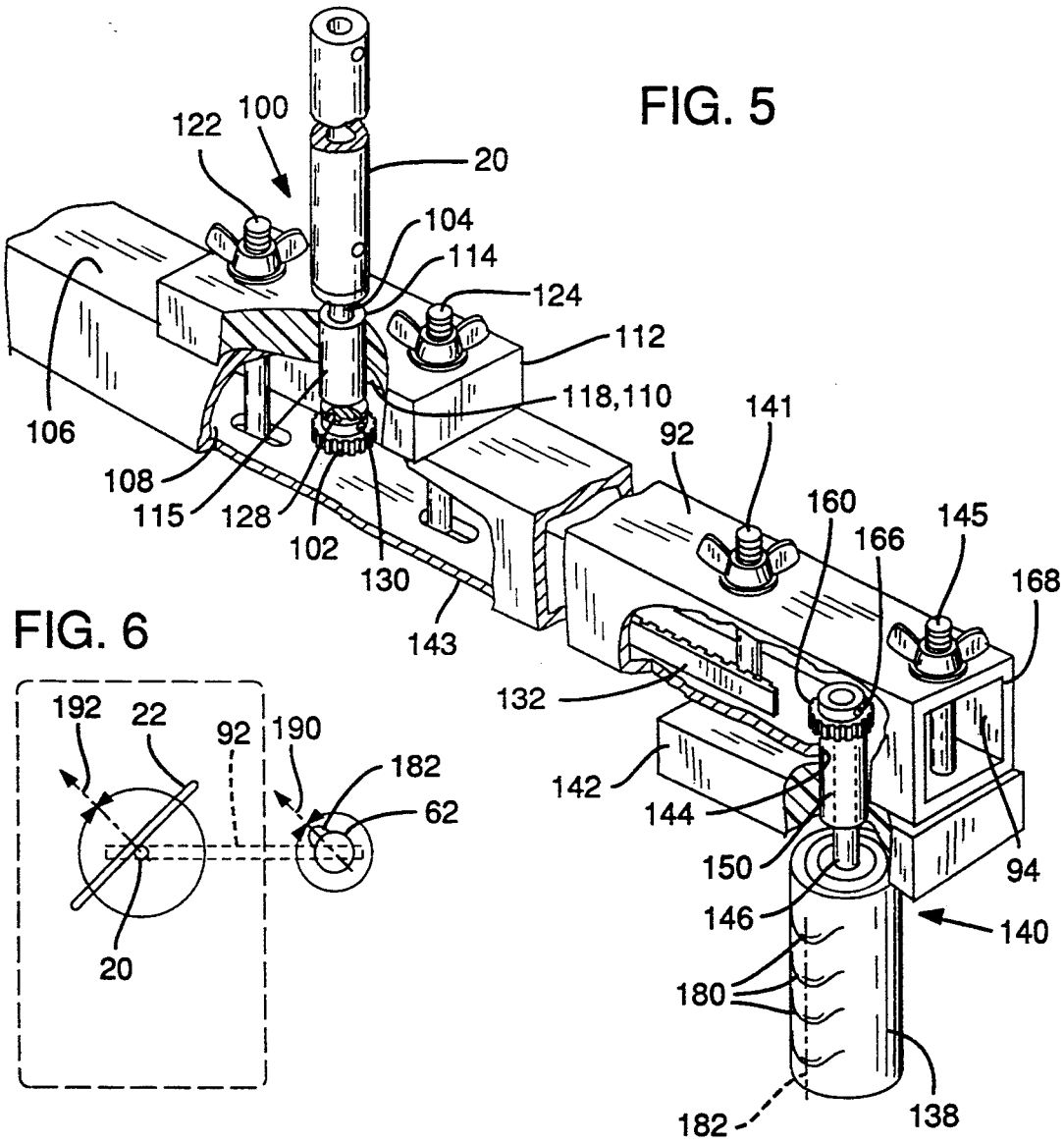
FIG. 6

VEHICULAR MOUNTING SYSTEM FOR DIRECTIONAL ANTENNAS

BACKGROUND AND SUMMARY OF THE INVENTION

The invention relates generally to vehicular antenna mounts directional antennas and more particularly to a mounting system for a signal-locating directional antenna which is positioned centrally over the roof of a vehicle and includes a means for remotely controlling the rotational orientation of the antenna by an occupant of the vehicle without the need to provide a hole in the vehicle roof.

Signal-seeking or direction-finding antennas, referred to herein as directional antennas, are used in various applications such as radio communications and broadcast signal seeking. One important industrial application for directional antennas is the identification and location of radio frequency interference sources in power distribution systems, caused by equipment sparking. Vehicles equipped with directional antennas are used to locate sparking faults so repairs can be effected. A driver or technician in the vehicle rotates the antenna to the direction of the radio frequency emission and then drives the vehicle in the direction of the emission.

The optimal location for a directional antenna on a vehicle is centered above the roof. In that location, the antenna will generally not extend beyond the sides of the vehicle and is thus protected by the vehicle against lateral interference or damage. Heretofore, placement of the antenna in the center of the roof necessitated drilling a hole through the roof, or the provision of complex parallel-actuator linkages to control the direction of the antenna. Such systems are often difficult to install and disfigure the vehicle reducing its resale value. An example of a directional antenna mount designed to extend through a roof is shown in U.S. Pat. No. 4,663,632.

There is a need for an improved directional antenna mounting system which allows the antenna to be installed centrally on top of the roof without permanently disfiguring the vehicle. It would be particularly advantageous to provide an antenna mounting system for supporting a rotatable directional antenna on a conventional vehicular roof rack of the type used to carry objects other than antennas, such as boats, skis, luggage or the like. Such roof racks are designed for temporary, removable installation by releasably clamping onto the vehicle along the side edges of the roof. Roof racks are generally adjustable in length to fit on vehicles of different sizes. They can thus provide a very versatile base for a directional antenna.

There is also a need for an improved antenna mounting system for directional antennas which is compact and minimizes wind resistance.

Finally, it would be advantageous to provide a mounting system for a directional antenna which is controllable by a control handle which includes a means for positively indicating the direction the antenna is pointing without the need to physically observe either the antenna or the control handle.

Accordingly, an antenna mounting system is provided for supporting a rotatable antenna on a vehicle and for permitting selective rotation of the antenna about a vertical axis by an occupant of the vehicle. The mounting system comprises a support frame for mounting above the roof of the vehicle. It also comprises a mast holder supported on the frame for holding the mast of an antenna. The mast holder is rotatable about a generally vertical first axis to turn the antenna about the first axis. A direction controller, positionable adjacent a window of the vehicle, is rotatably supported on the frame for rotation about a generally vertical second axis. The controller permits an occupant of the vehicle to rotate the controller and the antenna by reaching through the vehicle window. The system also includes an endless transmission means extending between the mast holder and controller for transmitting rotary motion from the controller to the mast holder. The endless transmission means responds to changes in the rotational orientation of the controller and produces a responsive identical rotation in the mast holder.

In its preferred form, the endless transmission means of the antenna mounting system includes first and second sprockets operatively coupled together by an endless toothed drive belt. The belt extends generally horizontally between the mast holder and controller. The first sprocket is operatively connected to the mast holder and the second sprocket is operatively connected to the controller, allowing rotational movement of the controller to be duplicated in the rotational movement of the mast holder. An additional preferred feature of the invention is the inclusion of one or more tactile position indicators on the handle of the controller for indicating the rotational position of the handle. The tactile position indicators allow the rotational position of the control handle to be sensed by the person operating the antenna controller.

In one embodiment, the support frame of the antenna mounting system is an elongate tubular bar designed to be bolted to a standard vehicular roof rack of a type usually employed to carry things other than directional antennas. In another embodiment of the invention, a horizontal tubular bar on the roof rack is fitted with a rotatable mast holder and a direction controller, and the transmission drive belt is threaded through the center of the roof rack bar. Thus, in the second embodiment, the bar on the roof rack becomes the support frame of the antenna mounting system to provide a compact, economical antenna controller.

BRIEF DESCRIPTION OF THE DRAWINGS

FIG. 1 is a side elevation of the antenna mounting system of the present invention, mounted on a vehicular roof rack, as viewed from the rear of the vehicle with the vehicle in partial cross section and the vehicle occupants indicated schematically.

FIG. 2 is a perspective view of the antenna mounting system of FIG. 1, partially cut-away, illustrating the internal components of the mounting system, its operative parts, and its connection to the roof rack of FIG. 1.

FIG. 3 is an enlarged, partially schematic, crosssectional view taken along line 3—3 of FIG. 2, showing the rotatable mast holder sprocket within the frame member.

FIG. 4 is a side elevation as in FIG. 1 of an alternative embodiment antenna mounting system in accordance with the present invention, as viewed from the rear of a vehicle, with the vehicle in partial cross section and the vehicle occupants indicated schematically.

FIG. 5 is a perspective view, as in FIG. 2, of the embodiment of FIG. 4, partially cut-away, illustrating the internal components of the antenna mounting system.

FIG. 6 is a schematic illustration of the operation of the antenna mounting system illustrating the operation of the tactile position indicator on the control handle.

DETAILED DESCRIPTION OF THE PREFERRED EMBODIMENT

Referring to FIG. 1, the antenna mounting system of the present invention is particularly adapted for mounting a rotatable directional antenna 10 on the roof 12 of a vehicle 14 such as a car or truck. Directional antennas are used to determine the direction of incoming radio frequency electromagnetic waves. Antenna 10, depicted schematically in FIGS. 1, 4 and 6, typically includes a coil shaped to pick up signals most strongly over a narrow angular receiving range. Such antennas suppress or ignore signals outside that angular receiving range. The antenna mount of the present invention is designed to permit selective rotation of the antenna about a generally vertical axis. The angular orientation of the antenna is controlled by an occupant of vehicle 14, either the driver 15 or passenger 16, as described below.

In the first embodiment of the vehicular antenna mount 25, shown in FIGS. 1-3, an elongate tubular frame member 26 is provided for attachment to a conventional vehicular roof rack 28 of the type designed to releasably attach to a vehicle and extend over its roof. Roof rack 28 is conventional and includes a generally horizontal, tubular bar 30 and a pair of slidable or laterally-adjustable clamping members 32, 34. Horizontal bar 30 is usually supplied oversized (i.e., overlong) and the clamping members are slidably attached to the bar so they can be adjusted to fit the width of the vehicle roof. After determining the required length of bar 30, some manufacturers of roof racks suggest that the installer shorten the bar 30 by cutting off any excess length. That allows for the provision of an extension on at least one end of bar 30, where the bar extends beyond clamp member 34, as shown in FIG. 1, to accommodate a connection at bolt 35 between the horizontal bar 30 and the tubular frame member 26.

All parts of the antenna mounting system are supported on frame member 26. Referring to FIG. 2, wherein selected portions of the tubular frame 26 are broken away to reveal interior parts of the antenna mount, a rotatable mast holder 38 is provided adjacent one end of the frame member. The mast holder includes a pivotable sprocket 40 operatively connected to a vertical support shaft 42 which extends upwardly through an opening 44 in the top side 43 of frame member 26. Vertical support shaft 42 serves as a releasable attachment point for the mast 20 of antenna 10.

The internal configuration of mast holder 38 is illustrated in FIG. 3, which is a cross-sectional view taken generally along line 3—3 of FIG. 2. Vertical shaft 42 extends along the first rotational axis 46 about which the antenna 10 and mast 20 rotate. Shaft 42 is operatively connected to a sprocket 40 positioned within the interior frame member 26. The sprocket rests on a thrust bearing 54 fitted into a lower opening 56 in frame member 26. A upper sleeve bearing 58 is fitted into an upper opening 44 of frame member 26. Bearing 58 supports the portion of shaft 42 which emerges from the upper side 43 of frame 26. Shaft 42 is coupled to sprocket 40, and both rotate together about first rotational axis 46. The antenna mast 20 is attached to shaft 42 by a bolt 48 shown in FIG. 3. Bearings 54 and 58 allow the antenna on mast 20 to rotate freely through 360-degrees.

Adjacent the other end 60 of tubular frame member 26 is a direction controller in the form of a control handle 62 rotatably supported on the frame. Handle 62 is elongate and generally cylindrical and is rotatable about a second rotational axis 66 on the antenna mount. Second rotational axis 66 is parallel with first rotational axis 46. Handle 62 includes an outside grip member, which is the visible part of the handle, as well as an internal cylindrical base 63. The handle is connected to a cylindrical shaft 64 which emerges from the top of the handle along the second rotational axis 66. Shaft 64 provides an operative connection between handle 62 and a second sprocket 70 mounted within the open interior 52 of frame 26.

Second sprocket 70 is preferably carried on a tensioning slider 72 which fits within the interior 52 of housing 26. Suitable upper and lower bearings (not shown) carried on the tensioning slider rotatably support second sprocket 70 and also carry shaft 64 and handle 62. The handle shaft 64 extends through an elongated slot 74 in the bottom side of frame member 26. The slot 74 permits the tensioning slider 72, sprocket 70, shaft 64, and handle 62 to slide longitudinally along frame 26 to adjust the tension on the sprocket-engaging belt, described below. Tensioning slider 72 can be fixed in any desired position along frame 26 by means of a locking screw (not shown) which extends through slot 78 or another suitable slot on frame 26.

Operative interconnection between first sprocket 40 and second sprocket 70 is provided by an endless transmission means, preferably in the form of a toothed belt 80 which engages cooperating teeth on sprockets 40, 70. Toothed belt 80, also referred to as a timing belt, extends generally horizontally through the interior 52 of frame 26, between control handle sprocket 70 and the mast holder shaft sprocket 40. Full 360-degree rotation is available for antenna 22. Except for limitations necessitated by connecting wires 79 which extend between the antenna coils 22 and a receiving apparatus in the vehicle (not shown), the antenna could be turned an unlimited number of times in either direction, by operation of the handle 62. Belt 80 reproduces the rotational motion between control handle 62 and antenna mast support shaft 42 because first and second sprockets 40, 70 are of equal size. Thus, any changes in the rotational orientation of controller handle 62 produces a responsive and equal rotation of mast holder 42.

Directional antenna mount 25 is attached to the horizontal bar 30 of roof rack 28 by means of suitable bolts 35, 82 which extend through the body of the bar and also through openings formed in the top 43 and bottom 75 of frame 26. Spacer washers 86 on bolts 35, 82 are used to space the frame 26 slightly above horizontal bar 30 to clear parts of the roof rack. In the first embodiment of FIGS. 1-2, two connecting bolts 35, 82 are positioned generally at opposite ends of frame 26. The number and location of the connecting bolts is a matter of design choice and any number of bolts can be used, as necessary, to securely attach the antenna mount to the roof rack. The bolts will not interfere with the operation of belt 80 as long as they are positioned along the center of frame member 26 and fit in the space between the two sides of belt 80. Plugs (not shown) can be installed in the open ends of frame member 26 to fully enclose the operative parts.

FIGS. 4 and 5 illustrate an alternative embodiment of the directional antenna mounting system of the present invention. The antenna 10 is the same as in the first embodiment. Antenna 10 is supported vertically on mast 20 which is supported on a mounting system incorporated into a conventional roof rack 90 of the same type as roof rack 28 shown in FIG. 1. Roof rack 90 includes side clamps 32, 34 for engaging the roof 12 of the vehicle, like the first embodiment rack 28. Horizontal bar 92 of rack 90 is a tubular metal or plastic bar, preferably rectangular in shape, with an open interior 94 (see FIG. 5).

In this embodiment, roof rack 90 has been modified to include a rotatable mast holder 100 positioned generally midway between the mounting support clamps 32, 34. Referring to FIG. 5, mast holder 100 includes a first drive sprocket 102, like drive sprocket 40 of the first embodiment, operatively connected to a mast support shaft 104. First sprocket 102 is supported within horizontal bar 92 of the roof rack by an upper support block 112 which is bolted to the top side 106 of bar 92. Upper support block 112 is preferably a block of steel, plastic or another suitable material with a central opening 114 (shown partially cut away in FIG. 5) drilled through the block. A cylindrical sleeve bearing 115 or roller bearing is fitted into opening 114 and vertical mast support shaft 104 extends through the center 120 of bearing 115. Shaft 104 includes an outwardly extending shoulder (not shown) designed to rest on top of bearing 115 to carry the weight of the antenna and to vertically position sprocket 102. First sprocket 102 is operatively coupled to shaft 104 by any suitable means, such as splines and is secured to the shaft by a roller pin 130 or by another suitable mechanical connection. Upper support block 112 is bolted to horizontal bar 92 by a pair of suitable bolts 122, 124 which extend through holes drilled in the bar.

To assemble the mast holder, after installation of the block on horizontal bar 92, the sprocket 102 is inserted through one of the open ends 168 of bar 94 and is slid to its correct position centrally within the bar. A drive belt 132 is preferably inserted into horizontal bar 92 at the same time sprocket 102 is slid into position. Shaft 104 is then inserted downwardly through the central opening 120 of bearing 115 and into sprocket 102. Prior to final positioning of sprocket 102 in bar 92, toothed drive belt 132 should be fitted around the sprocket.

At the end of roof rack bar 92 where the control handle is to be installed, preferably adjacent a window of the vehicle 12, a lower support block 142 is installed on the underside 143 of the bar. Block 142 supports the direction controller 140 of the second embodiment, including a rotatable control handle 138 like handle 62 of the first embodiment. Lower support block 142 has a central opening 144 (shown partially cut away in FIG. 5) into which a sleeve or roller bearing 150 is fitted. A support shaft 146 for control handle 138 extends through the central opening of bearing 150. Shaft 146 extends upwardly through the bottom of horizontal bar 92. The upper end of the control handle shaft 146 is operatively connected to a second sprocket 160, which is like sprocket 70 of the first embodiment. Bearing 150 is preferably provided with an upper surface (not shown) which engages a cooperating bearing surface on the lower side (not shown) of sprocket 160. The sprocket thus can ride on the top of bearing 150, providing vertical support for handle 138. Sprocket 160 and handle 138 are secured to opposite ends of shaft 146 by means of roller pins (not shown) or by another suitable means.

Assembly of the direction controller of the second embodiment of the antenna mount requires insertion of sprocket 160 through the open end 94 of horizontal bar 92. The sprocket is first loosely fitted inside the previously installed drive belt 132 and is drawn out toward the open end 168 of horizontal bar 92 by any suitable means, such as a hooked piece of wire. Lower support block 142 is then bolted to the underside of horizontal bar 92 using bolts 141, 145. Shaft 146 is inserted upwardly through the central opening 152 of bearing 150 and into sprocket 160. Once shaft 146 is properly positioned, the sprocket can be secured to shaft 146 by means of roller pins or another suitable means. Upper support block 112 and lower support block 142 help stabilize the mast support shaft 104 and control handle 138, respectively, and provide support for the bearings on shafts 114 and 146, respectively.

Once belt 132 is installed within bar 92 around sprockets 102 and 160, the belt forms an endless transmission means extending horizontally between the mast holder and direction controller of the second embodiment. The toothed belt works in the same manner as belt 80 of the first embodiment, transmitting changes in the rotational orientation of controller handle 138 to produce a responsive rotation of the mast holder shaft 104. First and second sprockets 102, 160 are preferably of equal size so that the angular changes between handle 138 and mast holder shaft 104 are equal.

The second embodiment of the invention utilizes the horizontal bar of the roof rack for both carrying and enclosing the transmission belt. It is somewhat more complex to install than the first embodiment, which can be preassembled and simply bolted to the roof rack. On the other hand, the second embodiment is more compact, reduces wind resistance and gives somewhat greater flexibility in the location of both the antenna mount and control handle.

In both the first and second embodiments, the control handle is preferably covered with a handle grip which includes one or more tactile position indicators 180 that indicate the rotational position of the handle to a person grasping it. Because the antenna mounting system places the antenna out of sight on the roof of the vehicle, the occupants of the vehicle are unable to see where the antenna is pointed. Tactile position indicators 180 allow the antenna operator to feel the direction of the antenna without having to look at either the antenna or the handle. In the illustrated embodiments, tactile indicators 180 are in the form of a plurality of bumps or protuberances extending along a line 182 extending lengthwise along the handle. In other words, the line of protuberances 182 extends lengthwise along the longest dimension of the handle, parallel with the vertical second axis 183 of the control handle. Protuberances 180 can alternatively be a continuous ridge formed lengthwise along the handle, or another suitable tactile indicator such as a groove, or a series of depressions which can be sensed by someone grasping the handle.

Referring to FIGS. 1 and 6, operation of the directional antenna mounting system of the present invention requires an operator, usually either the driver or the passenger of the vehicle, to reach through a window opening 186 of the vehicle 12, to grasp the control handle. With the understanding that the operation of the first and second embodiments is identical, this description will refer to the reference number of the first embodiment of FIGS. 1–2. In FIG. 6, handle 62 is shown in an exaggerated scale, with protuberances 180 also enlarged. The handle 62 is turned such that the protuberances are "aimed" in a general direction 190. Antenna coils 22 on mast 20 are also turned to receive a signal in direction 192, which is parallel with handle direction 190. Assuming the handle and antenna mast are properly aligned, any rotational change in handle 62 will produce a simultaneous rotational change in the direction of antenna 10. Should any misalignment occur between handle 62 and antenna 10, it will be necessary to reposition the handle or antenna relative to one another. The easiest way to accomplish such a correction is to reposition the antenna on mast 20 until it is exactly aligned with the direction 190 of protuberances 180. With the antenna properly aligned, the protuberances will provide a precise indication to the operator of the direction of the antenna.

The vehicular mounting system for directional antennas of the present invention provides an optimal central roof mounting position for a directional antenna without the need to drill a hole through the roof of the vehicle. By using a conventional roof rack of the type usually employed to carry objects other than a directional antenna, the mounting system can be installed on virtually any vehicle, since roof racks are made in a variety of sizes and types to fit most vehicles. The mechanism for remotely controlling the rotational orientation of the directional antenna is completely enclosed, preventing foreign matter from entering the mechanism. The provision of a tactile positioning indicator on the control handle is superior to other alternative position indicators such as crank arms, radially-projecting arms or longer, more visible projections which might become entangled with objects as the vehicle is driven. Because roof racks can be installed almost anywhere on the roof of a vehicle, the present invention allows it to be easily positioned at the most comfortable location for the operator. Similarly, the antenna can be optimally positioned, and can also be repositioned easily, something that is impossible with antennas that extend through a hole in the roof.

Alternative embodiments of the antenna mounting system are possible within the scope of the present invention. For example, the toothed endless drive belt used to transmit rotary motion between the control handle and mast support can be replaced by other types of endless transmission means and sprockets, such as roller (i.e., bicycle) chains, link chains, bead chains, ladder cable or similar devices. Multiple or redundant drive belts could be used (if sufficient room is available within the frame housing) by stacking parallel sprockets on the mast support and handle shafts. The conventional roof rack shown in the figures and employed as part of the antenna mount in the second embodiment is illustrative only, and other types of roof racks can be employed with the antenna mount of the present invention. A principal requirement in any roof rack used with a second embodiment of the present invention is that it have a sufficiently long, straight, tubular bar through which the drive belt can be threaded. A roof rack having a curved main bar extending laterally across the vehicle roof could be used to support the first embodiment antenna mount by installing shims or other spacing devices at appropriate locations to ensure that the antenna mast is substantially vertical. Finally, the toothed belt transmission system need not be enclosed within a frame or housing in order to function and it is within the scope of the present invention to employ an open-belt transmission. A rotation limiter can be provided, if desired, to prevent repeated looping of the connector cord around the antenna mast which might damage the cord or antenna. Such a rotation limiter could be a short piece of nylon rope or the like extending between an attachment point on the antenna mast and the roof rack. The length of the cord could be selected to permit 360-degrees rotation of the antenna, or more, but will stop rotation before it exceeds a predetermined limit. Other types of rotation inhibitors are well known to those skilled in the art. Other changes and modifications within the scope of the invention will occur to those skilled in the art.

What is claimed is:

1. An antenna mounting system for supporting a rotatable antenna on a vehicle and for permitting selective rotation of the antenna about a generally vertical axis by an occupant of the vehicle, the mounting system comprising:

a support frame for mounting above the roof of a vehicle, a rotatable mast holder supported on the frame for holding a mast of an antenna, the mast holder being rotatable about a generally vertical first axis to turn the antenna about the first axis, a direction controller including a longitudinal handle rotatably supported on the frame for axial rotation about a generally vertical second axis which extends lengthwise through the handle, said second axis being stationary relative to the support frame, the handle being positionable adjacent a window of the vehicle wherein an occupant of the vehicle axially rotates the handle by reaching through the window, and an endless transmission which extends between the mast holder and the handle and transmits endless rotary motion from the handle to the mast holder, wherein changes in the rotational orientation of the handle produces a responsive rotation of the mast holder.

2. An antenna mounting system as in claim 1 in which the endless transmission includes a first sprocket operatively connected to the mast holder, a second sprocket operatively connected to the handle, and a sprocket-engaging loop for engaging the first and second sprockets to transmit endless rotational motion from the handle to the mast holder.

3. An antenna mounting system as in claim 2 in which the sprocket-engaging loop is a continuous-toothed belt extending around the first and second sprockets.

4. An antenna mounting system as in claim 1 in which the handle includes one or more tactile position indicators for positively indicating the rotational position of the handle to a person grasping it, wherein the rotational positions of the direction controller and the mast holder are indicated.

5. An antenna mounting system as in claim 3 in which the continuous-toothed belt extends generally horizontally between the controller and the mast holder.

6. An antenna mounting system as in claim 4 in which one or more of the tactile position indicators extend lengthwise along an outside surface of the handle.

7. An antenna mounting system as in claim 4 in which the handle is generally cylindrical, and each tactile position indicator includes a protuberance on the handle.

8. An antenna mounting system as in claim 1 in which the support frame is a vehicular roof rack and the mast holder, direction controller and endless transmission are supported on the roof rack.

9. An antenna mounting system as in claim 1 in which the support frame is attachable to a vehicular roof rack which extends over the vehicle roof, the frame being of sufficient size to position the mast holder generally centrally on a vehicle roof with the direction controller adjacent a window of the vehicle.

10. An antenna mounting system as in claim 1 in which the support frame includes an elongate tube having first and second ends and an open interior extending lengthwise along a central axis of the tube, the mast holder being located adjacent the first end of the tube and the direction controller being located adjacent the second end of the tube, and the first and second axes being generally perpendicular to the central axis of the tube.

11. An antenna mounting system as in claim 10 in which the endless transmission includes a first sprocket operatively connected to the mast holder, a second sprocket operatively connected to the handle, and a sprocket-engaging loop for engaging the first and second sprockets to transmit rotational motion from the handle to the mast holder, and the first and second sprockets and the transmission loop are positioned in the open interior of the tube.

12. An antenna mounting system as in claim 1 in which the handle including one or more tactile position indicators which when aimed in a handle direction are parallel to an antenna direction from which a signal is to be received.

13. An antenna mounting system for supporting a rotatable antenna on a vehicle and for permitting selective rotation of the antenna about a generally vertical axis by an occupant of the vehicle, the mounting system comprising:

a support frame for mounting above the roof of a vehicle, a rotatable mast holder supported on the frame for holding a mast of an antenna, the mast holder being rotatable about a generally vertical first axis to turn the antenna about the first axis, a direction controller including a longitudinal handle rotatably supported on the frame for axial rotation about a generally vertical second axis which extends lengthwise through the handle, said second axis being stationary relative to the support frame, the handle being positionable adjacent a window of the vehicle wherein an occupant of the vehicle rotates the handle said second axis being stationary relative to the support frame, by reaching through the window, and endless transmission means which includes a first sprocket operatively connected to the mast holder, a second sprocket operatively connected to the handle, and a continuous-toothed belt extending around the first and second sprockets for transmitting endless rotary motion from the handle to the mast holder, wherein changes in the rotational orientation of the handle produces a responsive rotation of the mast holder.

* * * * *